United States Patent [19]

Blackmon

[11] Patent Number: 4,884,305

[45] Date of Patent: Dec. 5, 1989

[54] DEVICE FOR MAINTAINING BEDDING IN PLACE

[76] Inventor: Laura M. Blackmon, 420 San Saba, El Paso, Tex. 79912

[21] Appl. No.: 327,107

[22] Filed: Mar. 22, 1989

[51] Int. Cl.[4] ..... A47G 9/04

[52] U.S. Cl. ..... 5/496; 24/72.5

[58] Field of Search ..... 5/508, 494, 496, 482; 24/72.5

[56] References Cited

U.S. PATENT DOCUMENTS 2,155,690 4/1939 Simpson .
2,188,576 1/1940 Mulloy ..... 5/498
2,239,017 4/1941 Roberts .
3,143,747 8/1964 McSorley et al. .
4,021,869 5/1977 Root .
4,461,049 7/1984 Hammond ..... 5/496

*Primary Examiner*—Alexander Grosz
*Attorney, Agent, or Firm*—James J. Brown

[57] ABSTRACT

A device is described for maintaining bedding, such as the bottom sheet and mattress pad, in place on a mattress and preventing its becoming dislodged due to either the movement of the bed itself or its occupant. The device is a partial coverlet which fits over a portion of the end of the mattress and is held in place by elastic straps which grip the sides of the mattress to hold the mattress pad and sheet so that they do not pull off.

7 Claims, 3 Drawing Sheets

DEVICE FOR MAINTAINING BEDDING IN PLACE

SUMMARY OF THE INVENTION

The present invention is directed to a device for maintaining bedding in position on a mattress. More particularly the present invention is directed to a device which envelopes a portion of one end of a bed or mattress to engage and hold in place the bottom sheet and mattress pad which customarily are placed on the bed and which often become dislodged either through movement of the mattress or bed itself or the individual in the bed.

BACKGROUND OF THE INVENTION

A problem which is frequently encountered both by restless or otherwise active sleepers or individuals in beds which can be elevated or otherwise adjusted is that the bottom sheet placed around the mattress of the bed and mattress pad frequently become dislodged so that by morning both can be almost totally disengaged from a part of the mattress thereby placing the individual in contact with the mattress itself and the underlying pad. This is a problem which exists both with respect to typical fitted sheets which are constructed to fit the contours of the mattress or by the more conventional flat sheets which must be folded and tucked in underneath the mattress. The problem can be especially aggravating and even potentially dangerous in situations such as hospitals where beds are frequently elevated or otherwise adjusted to prop the individual up and where patients using these beds are sometimes either indisposed or incapable of adjusting or rearranging the bed clothing themselves. Thus, the bed-ridden patient may in the course of using the bed encounter a dislodged bottom sheet and mattress pad which cannot only become uncomfortable to sleep on but can actually become dangerous by becoming entangled with the individual or the individuals clothing and other bed coverings.

Accordingly, it is an object of the present invention to provide a device which can quickly and easily be placed over the top portion of a bed mattress to engage and hold in place the underlying bottom sheet and mattress pad so that they do not become dislodged either through movement of the mattress itself or the occupant of the bed.

It is a further object of the present invention to provide a device for maintaining the position of the bottom sheet and mattress pad on a bed, which device can easily and inexpensively be manufactured and which can be cleaned along with the other bed linens to provide a safe reusable means for maintaining the bottom sheet and mattress pad on a bed.

DISCUSSION OF THE PRIOR ART

U.S. Pat. No. 4,021,869 to Root describes a top sheet or blanket having an elastic binding at its bottom edge and around the two bottom corners for fitting the sheet or blanket to the bottom of the bed.

U.S. Pat. No. 3,143,747 to McSorley et al. describes a bed clothes clamp which consists of a semirigid frame that is held in place by a pair of elastic straps with hooks attached to engage the underside of the bed.

U.S. Pat. No. 2,239,017 to Roberts describes a coverlet for beds or mattresses which is provided with means for holding it and additional bedding in place. The fasteners used to secure the bed covering are described as zippers.

U.S. Pat. No. 2,155,690 describes a device for holding bed covers in place which consists of a flexible netting which extends laterally over the bed and is held in place by means of hooks attached to drawstrings or cords.

U.S. Pat. No. 4,461,049 to Hammond describes disposable fitted sheets which are provided at their corners with elastic bands.

DETAILED DESCRIPTION OF THE INVENTION AND A PREFERRED EMBODIMENT THEREOF

In accordance with the present invention a device is provided for maintaining bedding such as the bottom sheet and mattress pad of a bed in position on a mattress. The device of the present invention essentially consists of a rectangular section of material, such as cloth, which is longitually folded to form two roughly equal halves. The respective pairs of opposing corners of these two section on either side are joined by elongated elastic strips. The elastic strips are of sufficient length to extend under tension from the top to the underside of the top of the mattress thereby enveloping the head of the mattress and forming a relatively tightly fitting cap or envelope over the top of the mattress. Thus, once the bottom sheet and mattress pad is properly in place on the mattress, the device of the present invention is slipped over the end of the mattress to thereby form a snugly engaged covering which prevents the underlying bottom sheet from becoming disengaged from the mattress. The material forming the device of the invention is somewhat shorter in length than the width of the mattress so that the elastic strips joining the ends are under tension and actually grip the sides of the mattress to give a snug, tight fit. It will be appreciated that the present invention is equally useful with either fitted or unfitted sheets since it will retain either type of sheet in place on the mattress and, in one embodiment, can be permanently attached to the sheet. It will further be apparent that the device of the present invention, while specifically designed to be used at the head of the bed or mattress to prevent that portion of the bottom sheet and mattress pad from becoming dislodged can also be used on the lower or bottom end of the mattress to prevent the bottom sheet from pulling out at that end. Generally, however since the total bed cover array is usually tucked in at the bottom, less of a problem is presented at that end of the bed then at the head of the bed which is normally left open to accommodate the individual using the bed. It will also be apparent that the device of the invention can usefully be employed at both the head and foot of the bed simultaneously to secure the bedding.

The present invention will however be more fully appreciated by having reference to the drawings which illustrate a preferred embodiment thereof.

Figure 1:
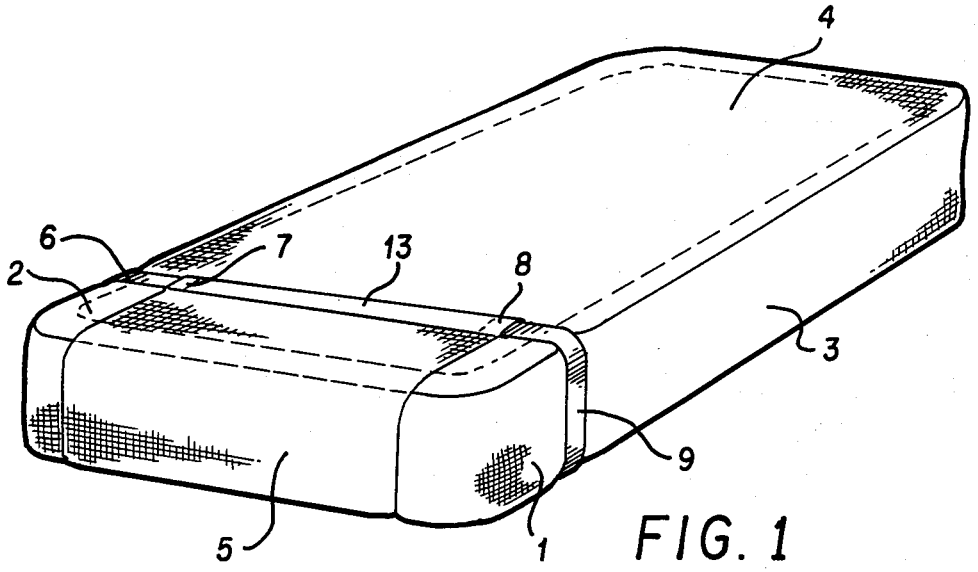
FIG. 1 is a perspective view of a mattress with bottom sheet and mattress pad held in place by the device of the invention.
Figure 2:
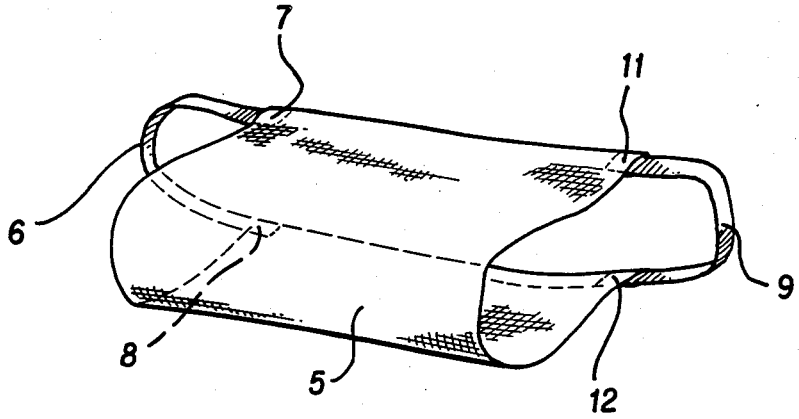
FIG. 2 is a perspective view illustrating in greater detail the device of the present invention removed from a bed or mattress.

Directing attention to FIG. 1 of the drawings, a mattress 1 is shown having a bottom sheet 3 and mattress pad 4 in place around it. The head of the mattress 2 which is the end where the pillow and head of the user would be placed is capped by the device of the present invention which includes a rectangular piece of material 5 that envelopes the head of the bed along with the portion of the bottom sheet engaging the head of the bed and the underlying portion of the mattress pad 4 and is snugly held in place by elastic straps shown at 6 and 9 which are connected at 7 and 8 to opposing end portions of the material 5. A hem 13 is provided to reinforce against stress produced by the tension of the straps 6. This is further illustrated in FIG. 2 of the drawings wherein the device is illustrated removed from the mattress. As shown in FIG. 2, the device consists of a folded rectangular section of material 5 with opposing corners joined together by elastic strips 6 and 9. Elastic strip 9 are joined to the corners 11 and 12 in the same manner as elastic strip 6 joins the corners 7 and 8.

Figure 3:
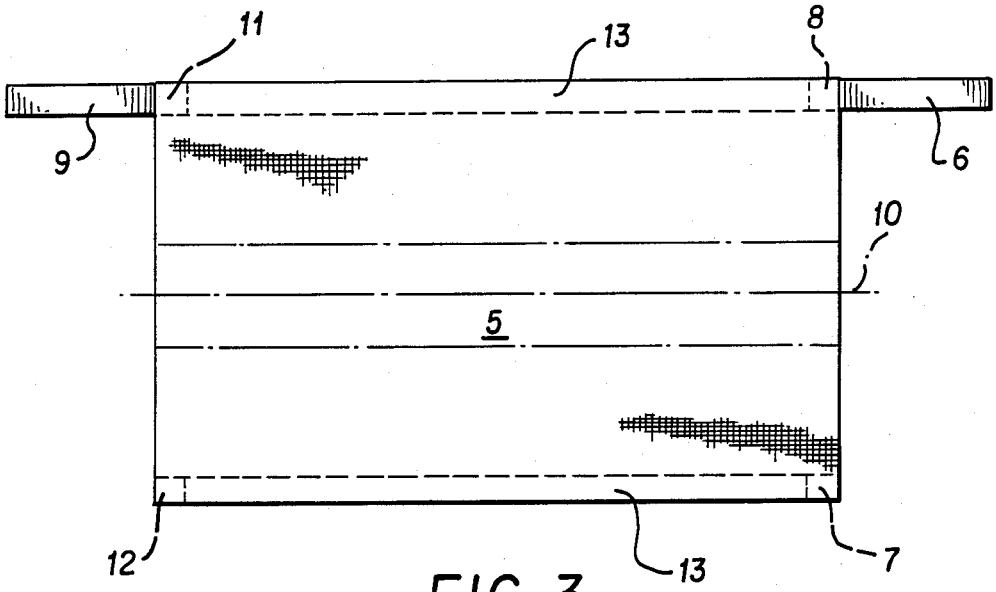
FIG. 3 is a top plan view showing the device of the invention in unfolded configuration and with the elastic straps partially disengaged.

Directing attention to FIG. 3 of the drawings, the device of the invention is shown in its unfolded, disconnected configuration in which the rectangular section of material 5 is laid out flat. Strips of elastic materials 6 and 9 are respectively joined to the corners 8 and 11 of the rectangular sheet 5. Reinforcing hems 13 are on opposing edges to relieve stress caused by tensioning the elastic straps. When connected to form the device of the invention in form ready to be placed on a mattress, the unattached end of the strip 6 is joined to corner 7 and the unattached end of the strip 9 is joined to the corner 12. This joinder necessitates folding the rectangular piece of material 5 generally along the center line 10 although it will be appreciated that the fold in the fabric does not produce a sharp crease but rather a "bowing" as illustrated in FIGS. 1 and 2 of the drawings.

In order to successfully engage and maintain the bottom sheet on a mattress, it is important that the elastic strips connecting the opposing ends of the rectangular material be of appropriate length to hold the rectangular sheet under tension around the end of the bed. If the elastic strips are too long, so that no tension is produced then the device can too easily itself slip of from the bed or become disarranged. Or, if the strips are too short, the device may not envelope the head of the mattress or the elastic may be extended too greatly to grip effectively. Beds of course vary in size. For example, hospital beds are narrower than standard twin beds. To fit a hospital bed properly, the width from corner 7 to corner 12 of sheet 5 should be no larger than 26½ inches and no smaller than 23 inches. The distance from the end of the elastic on one side of the cloth to the end of the elastic on the opposite side should be 32½ inches so that when in place the elastic strips actually engage tightly the sides of the mattress and the underlying bottom sheet and mattress pad to hold it securely in place. Thus, although the device of the present invention can be employed with any size mattress, it is necessary that the size of the device be adjusted in accordance with the size mattress with which it will be used.

Figure 4:
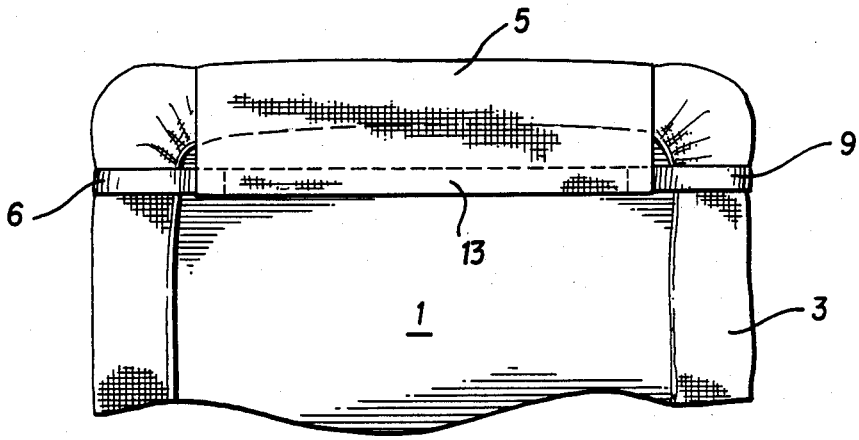
FIG. 4 is a perspective view of the bottom of a mattress with pad and the device of the invention.

FIG. 4 of the drawing illustrates the bottom of a mattress 1 with the device of the invention in place over fitted sheet 3. As shown the elastic straps 6 and 9 are stretched to provide tension so that they tightly engage and hold the sheet.

Figure 5:
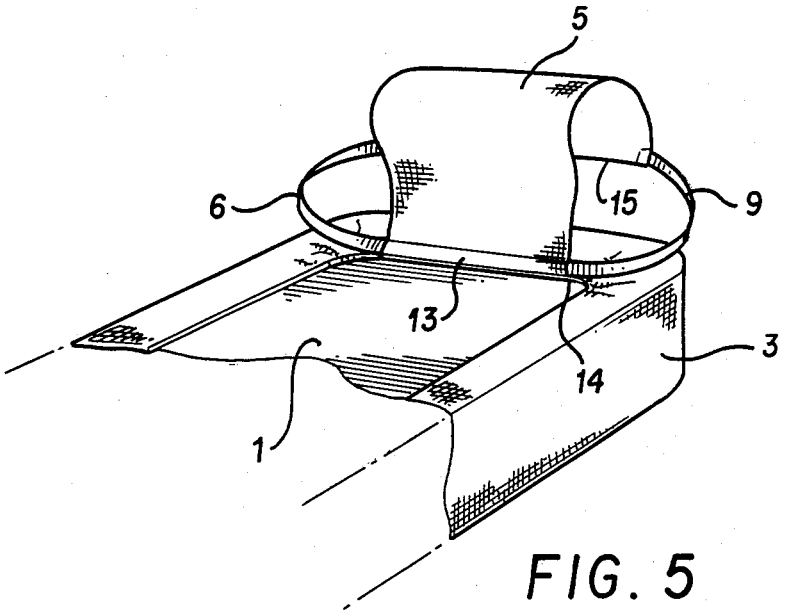
FIG. 5 is a perspective view of the underside of a mattress showing the device of the invention attached to a fitted sheet.
Figure 6:
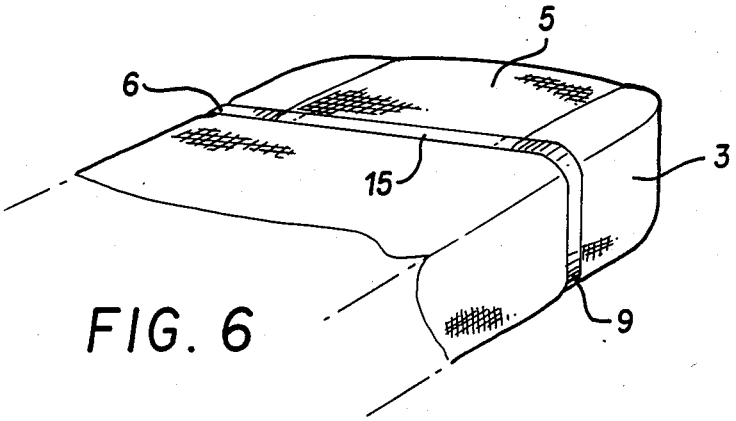
FIG. 6 is a perspective view of the top side of a mattress showing the device of FIG. 5 in place holding the sheet to which it is attached.

As illustrated in FIG. 5 and 6 of the drawings, the device of the invention can be permanently attached to the sheet. This is done by attaching one edge 13 to the tucked under top edge 14 of the sheet 3 as shown in FIG. 5, which illustrates the underside of a mattress 1 having a form fitting sheet 3 in place. The other edge of the device 15 is left free so that it can be brought up over the top side as shown in FIG. 6.

Although various materials can of course be employed in the present invention it is desirable that it be made of cloth similar to that usually employed for bedding such as cotton or mixed blend sheeting. This facilitates cleaning and maintenance of the device so that it can thereby be treated essentially like any other piece of bedding. Most advantageously the elastic strips employed should also be of a material which can withstand ordinary washing procedures and which can easily be attached such as by sewing to the rectangular piece of material forming the device of the invention.

While a preferred embodiment of the present invention has been described herein, it will be apparent to those of ordinary skill in the art that further modification in the present invention are considered to fall within the scope of the invention as defined in the claims appended hereto.

What is claimed is:

1. A device for maintaining bedding in position on a mattress comprising a single rectangular section of material folded along its longitudinal center line to form two halves, the respective pairs of adjacent corners of said section on opposite sides of said center line being joined by a pair of elongated elastic strips each of whose ends are joined to and extend from said adjacent corners parallel to said center line and are of sufficient length to extend under tension around the side of said mattress from the top side to the underside to thereby hold said folded section of material in tight engagement with one end of said mattress along with bedding placed thereon to prevent dislodgement thereof.

2. The device of claim 1 wherein said material is cloth.

3. The device of claim 1 wherein said halves are about equal in size.

4. The device of claim 1 wherein said bedding is the bottom sheet and mattress pad placed on the mattress.

5. The device of claim 1 which is permanently attached at one of its edges to said bedding.

6. The device of claim 5 wherein the device is attached to an edge of a sheet.

7. A device for maintaining bedding in place on a mattress comprising a single rectangular section of cloth which is folded along its longitudinal center line to form two generally equal halves; the respective pairs of adjacent corners of said section on opposite sides of said center line being joined by a pair of folded, elongated elastic strips each of whose ends are joined to and extend from said adjacent corners parallel to said center line and are of sufficient length to extend under tension around the side of said mattress from the top side to the bottom side to thereby hold said section in tight engagement with one end of said mattress along with said bedding to prevent its becoming dislodged.

* * * * *